United States Patent [19]

Perlman

[11] Patent Number: 4,851,702

[45] Date of Patent: Jul. 25, 1989

[54] RADIATION SHIELD

[75] Inventor: Daniel Perlman, Arlington, Mass.

[73] Assignee: Brandeis University, Waltham, Mass.

[21] Appl. No.: 130,411

[22] Filed: Dec. 9, 1987

[51] Int. Cl.[4] ..... G21F 1/00

[52] U.S. Cl. ..... 250/507.1; 250/506.1; 250/515.1

[58] Field of Search ..... 250/506.1, 507.1, 515.1; D24/31, 32; 422/100, 102, 104

[56] References Cited

U.S. PATENT DOCUMENTS

| | | | |
|---|---|---|---|
| 3,259,748 | 7/1966 | Lammers | 250/507.1 |
| 3,521,785 | 7/1970 | Bergmann et al. | 422/104 |
| 3,655,985 | 4/1972 | Brown et al. | 250/506.1 |
| 4,510,119 | 4/1985 | Hevey | 422/104 |
| 4,642,220 | 2/1987 | Bjorkman | 422/104 |

OTHER PUBLICATIONS

Nalgene Advertisement.

Price et al., "Radiation Shielding", The Macmillan Company.

U.S. Nuclear, Catalog Number 8.

*Primary Examiner*—Janice A. Howell

*Assistant Examiner*—Michael Aronoff

[57] ABSTRACT

A radiation shield suitable for preventing radiation and radioisotopes from reaching or contacting a person using a vessel containing a radioactive solution. The shield includes a radiopaque container having a top and a bottom opening, and a means for supporting the vessel within the container. The container reduces emission of radiation through the sides of the vessel.

13 Claims, 2 Drawing Sheets

RADIATION SHIELD

BACKGROUND OF THE INVENTION

This invention relates to radiation-blocking containers for shielding of radioactive solutions stored within substantially non-shielding vessels.

Generally, small vials or microcentrifuge vessels (microtubes) are commonly used to store and transfer small amounts of radioactive material such as $^{32}P$ and $^{125}I$ isotopes, which produce high energy $\beta$-particles. These radioactive materials are often combined with other chemical and biochemical ingredients and the resulting mixtures within these microtubes are subjected to incubations at a variety of temperatures. Microtubes are typically made of polyethylene or polypropylene and include a lid which snaps shut. These vessels have thin walls and provide little shielding from the emitted radiation for the laboratory worker manipulating the samples.

Existing radiation shields specifically designed to hold these microtubes consist of a heavy block of radiopaque material such as Plexiglass TM which may include multiple drilled-out cylindrical holes for holding several microtubes. Heavy radiopaque cannisters with lids are also used to store single microtubes.

SUMMARY OF THE INVENTION

The invention features a radiation shield suitable for preventing radiation or radioisotopes from reaching a person using one or more sample vessels holding a radioactive solution. The shield includes a radiopaque container, having a top and a bottom opening, and a means for supporting the vessel within the container. The container blocks $\beta$-radiation emitted through the sides of the vessel while allowing continued contact between the vessel and the environment via the bottom opening of the container.

In preferred embodiments, the container permits incubation liquid to enter the bottom opening of the container and surround that portion of the vessel holding radioactive solution; the container is a sleeve into which the vessel fits; the sleeve has a substantially flat bottom surface which allows it to rest in a free-standing position on a flat surface; the sleeve has a flange which allows it to be suspended in a rack, and permits incubation liquid to enter the bottom opening of the sleeve when it is suspended in the rack, and surround that portion of the vessel containing the radioactive solution; the container includes a rack for supporting a plurality of vessels, and a radiopaque shield is formed along the perimeter of the rack leaving the bottom of the rack open; the container includes a radiopaque cover for shielding radiation emanating through the top opening. In yet another embodiment, the container is a block of radiopaque material having a plurality of bores, which traverse the block, and the container is transparent.

This invention provides radiation shielding for vessels, microtubes, and other small vessels, with the sleeves or racks extending from the lid of a microtube to a point some distance below the microtube to minimize lateral exposure of radiation to the laboratory worker. For example, the laboratory worker can safely hold a sleeve by its sides without significant exposure of the hand to radioactivity. The geometry of the sleeves (open at the bottom) permits liquid in any incubator bath to directly enter the sleeve and surround at least the lower part of the microtube housed within the sleeve to allow accurate temperature control of the radioactive sample. Thus, the sleeve simultaneously provides an individual a portable shield which permits safe hand-manipulation of the vessel as well as direct liquid incubation of the shielded vessel.

Hand and finger exposure to radioactivity often occurs during pipeting operations involving hand-held microtubes and other small vessels. Such exposure is encountered in formulating radioactive cocktails for DNA sequencing reactions, conducting immuno precipitation reactions with radio-iodinated reagents, and hand-loading samples into various analytical devices to separate various radioactive molecular species. Manipulations of these sorts are almost impossible to complete without hand and finger contact with the small vessels bearing the radioactive solutions even when proper $\beta$-radiation shielding is being utilized. For these operations, the transparent sleeve provides both lateral radiation shielding of the microtube and physical separation between the lid of a microtube and the fingers holding the outer sleeve. This separation minimizes the risk of radioactive contamination to the hand caused by liquid residue on the lid of the microtubes accidentally contacting the gloved hand. Using the sleeves during microtube vortexing and other microtube manipulation steps further reduces radiation exposure of the fingers and the hands.

Thus, although narrow columns of radiation are permitted to escape upward and/or downward from the vessels, these columns do not create any great risk of exposure to radiation. On the contrary the shields allow easier manipulation of vessels and thus lower the risk of radioactive spills from the vessels caused by the awkwardness of other types of shielding. Transparent shielding also makes manipulation of the vessels easier since the user need not guess when he is touching the radioactive solution with, for example, a pipetting device.

Other features and advantages of the invention will be apprent from the following description of the preferred embodiments, and from the claims.

DESCRIPTION OF THE PREFERRED EMBODIMENTS

The Figures are first briefly described.

DRAWINGS

STRUCTURE

Figure 1:
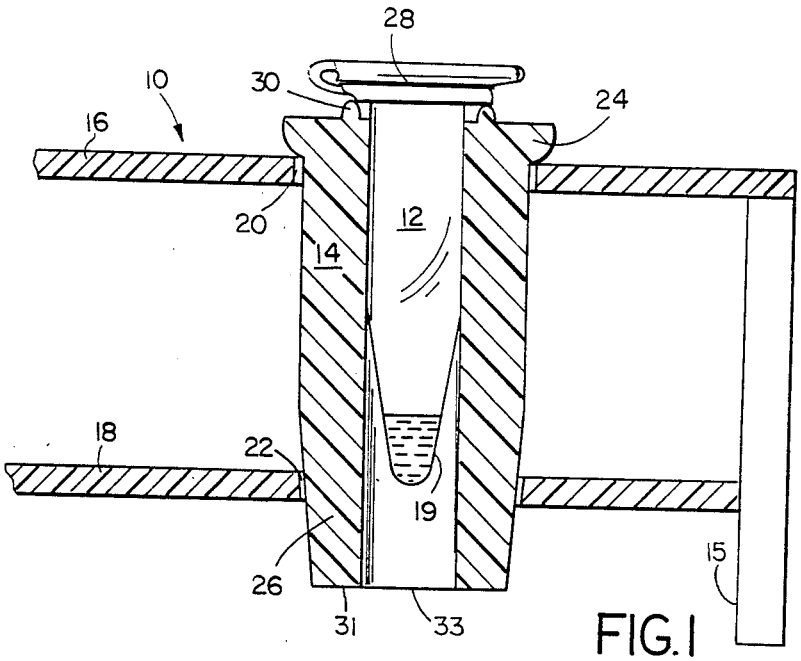
FIG. 1 is a partial sectional view of a microtube placed within a sleeve of radiopaque material and supported in a rack.

Referring to FIG. 1, radiopaque sleeve 14, containing microtube 12, containing radioactive solution 19, has a flange 24 for suspending it from a top shelf 16 of a rack 10, and a lower tapered portion 26 which extends through a lower shelf 18 of rack 10. Sleeve 10 is inserted within two concentrically aligned holes 20, 22 in rack 10. The bottom of sleeve 14 is slightly elevated from the lowest level 15 of the rack. Sleeve 14 is made of radiopaque plastic, such as Plexiglass TM, (acrylic) or Lexan TM (polycarbonate) and is approximately ¼ inch thick. This thickness is sufficient to block high energy β-particles.

The inner diameter of sleeve 14 is approximately equal to the outer diameter of microtube (about 1.0 cm) 12 so that when microtube 12 is inserted into sleeve 14, they are in close proximity. When microtube 12 is placed within sleeve 14, it extends only a portion of the way through sleeve 14. This prevents radiation from emanating from solution 19 in a horizontal direction. Both the outer surface and the inner surface of the sleeve are substantially optically transparent to allow visual inspection of solution 19.

Lid 28 of microtube 12 is elevated from flange 24 by a circular ridge 30 (or alternatively dimples) to facilitate access to lid 28. The base 31 of sleeve 14 is substantially flat, which allows it to rest in a free standing position so that sampling of the contents of microtube 12 is readily performed. Placed on rack 10, the geometry of sleeve 14 (open at the top and bottom) permits liquid in any incubator bath to directly enter sleeve 14 through bottom opening 33 and surround that portion of the microtube enclosing solution 19 contained in microtube 12.

OTHER EMBODIMENTS

Figure 2:
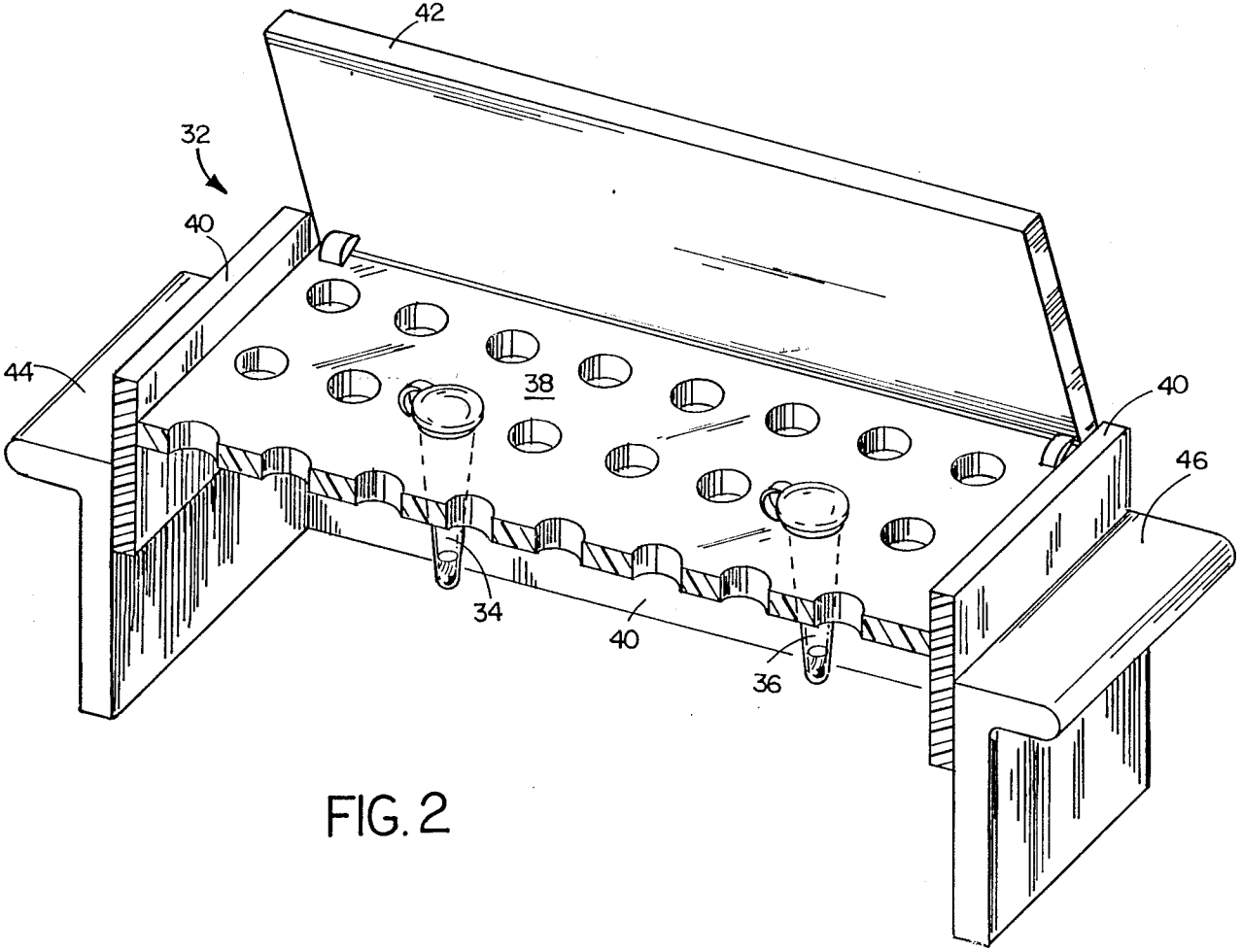
FIG. 2 is a perspective, partially sectional view of a radiopaque incubation rack.

Other embodiments are within the following claims. For example, referring to FIG. 2, an incubation rack 32 is designed for suspending several microtubes 34, 36 (only two are shown) from a single radiopaque shelf 38. A plastic skirt 40 surrounds the perimeter of shelf 38 and encloses microtubes 34, 36 suspended from shelf 38 (for clarity the front of skirt 40 is not shown). To prevent lateral radiation, skirt 40 extends just above and below the suspended microtubes 34, 36. Skirt 40 is elevated by two handles 44, 46 to permit incubation rack 32 to be placed in any water bath and allow incubation water (not shown) to circulate around the lower portion of microtubes 34, 36. A plastic lid 42 is hinged to skirt 40 and serves to block radiation emanating upward. Skirt 40 and lid 42 are made of transparent plastic at least ¼ inch thick for blocking β-emmitting particles. Identifying marks for suspended microtubes can be made on top of lid 42.

Figure 3:
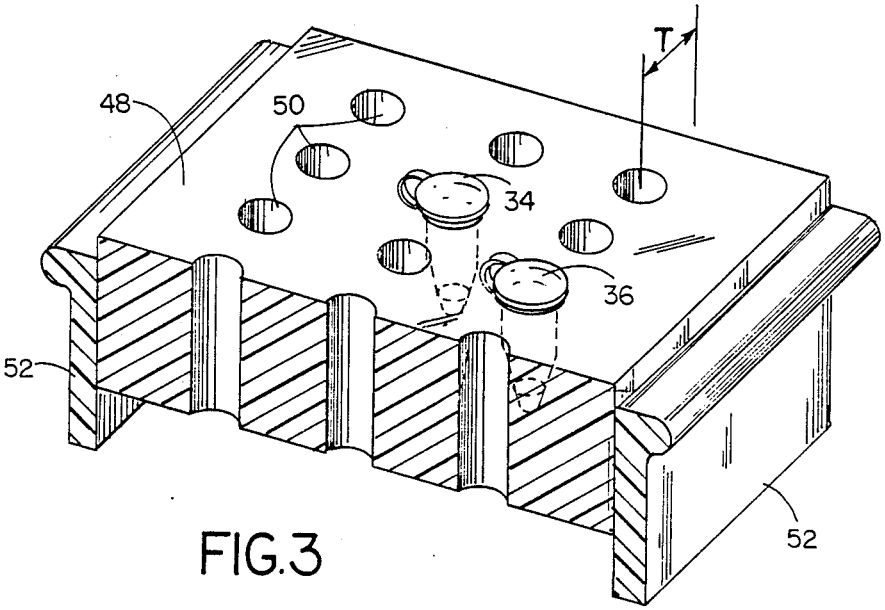
FIG. 3 is a perspective, partially sectional view of an alternate embodiment of an incubation rack that includes a block of radiopaque material having bores for suspending microtubes.

Referring to FIG. 3, a block of transparent, radiopaque material 48 is provided with a plurality of bores 50 which extend through block 48. Preferably block 48 is made of plastic such as Plexiglass TM and has a minimum thickness T of ¼ inch between bores 50 along the perimeter of block 48. Radioactive emission from the solution contained in microtubes 34, 36 is therefore limited to the top and bottom openings of bore 50. Handles 52 elevate block 48 and permit incubation water to circulate around microtubes 34, 36 suspended from the top of block 48.

I claim:

1. A radiation shield suitable for preventing radiation or radioisotopes from reaching or contacting a person using a vessel containing a radioactive solution, said shield comprising:

a radiopaque container having a top and a bottom opening; and means for supporting said vessel within said container without said means blocking said top or bottom opening, wherein said container reduces emission of said radiation through the sides of said vessel.

2. The radiation shield of claim 1 wherein said radiopaque container comprises means to permit incubation liquid to directly enter the bottom opening of said container and surround that portion of said vessel containing said radioactive solution.

3. The radiation shield of claim 1 wherein said container is a sleeve that fits over said vessel.

4. The radiation shield of claim 3 wherein said sleeve has a substantially flat bottom surface for allowing said sleeve to rest in a free-standing position on a flat surface.

5. The radiation shield of claim 3 wherein said container is sized and shaped to hold a microtube having a lid and comprises a ridge or dimples formed along said top opening to elevate the lid of the microtube from the sleeve to facilitate access to the lid.

6. The radiation shield of claim 3 wherein said sleeve comprises a flange for allowing suspension of said sleeve in a rack, wherein liquid may enter the bottom opening of said sleeve and surround that portion of said vessel containing said radioactive solution.

7. The radiation shield of claim 1 wherein said radiopaque container comprises an incubation rack for supporting a plurality of vessels and a radiopaque shield formed along the perimeter of said rack.

8. The radiation shield of claim 7 further comprising a radiopaque cover for shielding radiation emanating through said top opening.

9. The radiation shield of claim 1 wherein said radiopaque container comprises a block of radiopaque material having a plurality of bores.

10. The radiation shield of claim 1 wherein said container is transparent.

11. The radiation shield of claim 1 wherein said container is fabricated using acrylic, polycarbonate or other subtantially radiopaque plastic material.

12. A method for preventing radiation or radioisotopes from reaching or contacting a person using a vessel containing a radioactive solution, said method comprising the steps of:

providing a radiation shield having a radiopaque container with a top and bottom opening; and means for supporting said vessel within said container without blocking said top or bottom openings, wherein said container reduces emission of said radiation through the sides of said vessel;

placing said vessel within said radiopaque container; and transporting said vessel from a first position to a second position by holding said container without touching said vessel.

13. The method of claim 12 further comprising the step of placing said radiopaque container comprising said vessel within an incubation liquid whereby said vessel is caused to attain the temperature of said liquid.

* * * * *